US005137487A

United States Patent [19]

Hall, Jr.

[11] Patent Number: 5,137,487

[45] Date of Patent: Aug. 11, 1992

[54] SELF-REVERSING SYMMETRICAL BODY

[76] Inventor: Rudolph V. Hall, Jr., 220 Bruce St., Simpsonville, S.C. 29681

[21] Appl. No.: 712,407

[22] Filed: Jun. 10, 1991

[51] Int. Cl.[5] ..... A63H 1/00

[52] U.S. Cl. ..... 446/256; 434/300

[58] Field of Search ..... 446/256, 258, 259, 264; 434/300, 301, 302

[56] References Cited

U.S. PATENT DOCUMENTS 3,594,944 7/1971 Rondeau ..... 446/256

4,076,252 2/1978 Bernier et al. ..... 446/256 X

*Primary Examiner*—Mickey Yu

*Attorney, Agent, or Firm*—Richard C. Litman

[57] ABSTRACT

Disclosed is a self-reversing pendular-top formed as a symmetrical solid body of hard rigid material such as acrylic, the configuration being such that the center of gravity is oscillated relative to the geometric center of the pendular-top. The center of gravity may be further displaced from the geometric center by increasing the frequency with the symmetrical addition of counter-weights at each end of the device. When rotated counter-clockwise on a smooth surface, the pendular-top will eventually stop rotating, and thereafter, without further input of energy will start to rotate in the reverse direction (clockwise). Similarly, when the pendular-top is oscillated end-to-end or side-to-side, the oscillations will eventually be converted, without further input of energy, into a rotational spin about the vertical axis, which is clockwise and counter-clockwise respectively.

4 Claims, 3 Drawing Sheets

SELF-REVERSING SYMMETRICAL BODY

BACKGROUND OF THE INVENTION

1. Field of the Invention

This invention relates to a self-reversing symmetrical body which when rotated in one direction (counter-clockwise) will eventually begin to rock end to end and then on its own abruptly rocks and rotates until it starts rotating in the opposite directions (clockwise). Similarly, when the symmetrical body of this invention is rocked from end to end, the rocking motion eventually changes to a simultaneous rocking and rotation motion, and then without further energy input, the symmetrical body will start on its own to rotate clockwise producing what appears to be more energy output than originally placed into the system. The forces creating this effect are not fully understood, but it is believed that those forces are related to those which control the clockwise circular traverse of an oscillating pendulum, such as believed to be on display at the Smithsonian Museum in Washington, D. C.

2. Description of Related Prior Art

The known prior art is found in the area of toys, in particular, rotatable tops. U.S. Pat. No. 2,700,246 issued Jan. 25, 1955 to Werner Ostberg discloses a self-reversing top comprising a spherical body having an integral peg extending therefrom. The design is such that when the top is started to spin in an upright position, the top is automatically inverted so as to finally spin upon the flattened end of the peg. The top has an evenly distributed weight with reference to its vertical axis in all sections, so that no balancing of such weight is needed when making the top. The design is such that the center of gravity is slightly spaced from the geometric center of the body.

U.S. Pat. No. 3,594,944 issued Jul. 27, 1971 to Herbert F. Rondeau, William Clark Goodchild, Jr. and Hans Frederick Shaefer, Jr. discloses a self-reversing top which, when spun in one direction, will rotate first in that direction and then will reverse its direction of rotation. The top is of integral rigid construction having a curved lower contact surface, the direction of least curvature of which is angularly offset from the principal axis of inertia. The top may be formed of clear acrylic plastic. As disclosed by Rondeau et al., the contour of the top body is asymmetrical.

U.S. Pat. No. 4,643,922 issued Feb. 17, 1987 to James M. Fujiwara discloses a turtle-shaped figurine that includes an accurately rounded underside surface positioned for rocking the turtle forwardly and rearwardly about a transverse axis.

SUMMARY AND OBJECTS OF THE INVENTION

It is an object of this invention to provide a symmetrical body which when rocked end to end or rotated counter-clockwise will allow itself to be acted upon by a natural force which is believed to cause a clockwise deflection on some objects within the vicinity of the magnetosphere.

Another oject of this invention is to provide a body which will allow itself to be acted upon, in such a way as to permit the greatest possible effect of this clockwise deflecting force on the body.

Still another object is to provide a device which is capable of demonstrating the physical relationship between linear motion and rotational motion.

Yet, another object is to provide a device that embodies the principle of a simple pendulum, which is the concentration of a body's mass at a point or at its center of gravity in such a way as to allow it to swing to an fro as well as rotate about the vertical axis under the action of gravity.

The foregoing and other objects are achieved by forming the body of any dense material (the denser the better) that will hold a rigid symmetrical shape, such as acrylic plastic. From the side the body is curved upwardly at its ends relative to the center sections, thereby permitting the displacement of the center of gravity relative to the geometric center. These offset centers allow a moment of inertia to be established which at least contributes to the effects observed.

Other objects, features and advantages of the invention will become apparent from the following detailed description and the appended claims, reference being had to the accompanying drawings forming part of the specification, wherein like reference numerals designate corresponding parts of the several views.

BRIEF DESCRIPTION OF THE DRAWINGS

Fig. 5A shows counter-clockwise rotation. FIG. 5B shows end to end rocking. FIG. 5C shows side to side rocking. FIG. 5D shows clockwise rotation.

DETAILED DESCRIPTION OF THE PREFERRED EMBODIMENT

Before explaining in detail the present invention, it is to be understood that the inventon is not limited in its application to the details of construction and arrangement of parts illustrated in the accompanying drawings, since the invention is capable of other embodiments and of being practiced or carried out in various ways. Also it is to be understood that the phraseology and terminology employed herein is for the purpose of description and not limitation.

Shown in the several figures is a device 10 which functions as a pendular-top having unique properties. The dimensions of device 10 are found in Table I provided to enable others to duplicate the invention. The device 10 as shown in symmetrical, with the curve shown in FIG. 1 serving to raise the center of gravity above the geometric center. The frequency of rocking or oscillation which is believed to influence the number of clockwise rotations may be increased to a certain degree. This is done by adding counterweights 12 symmetrically at each end 16 of device 10 as in FIGS. 1 and 2. They increase the number of rocks (wave) in the same period (time) between the center of gravity relative to the geometric center.

Figure 1:
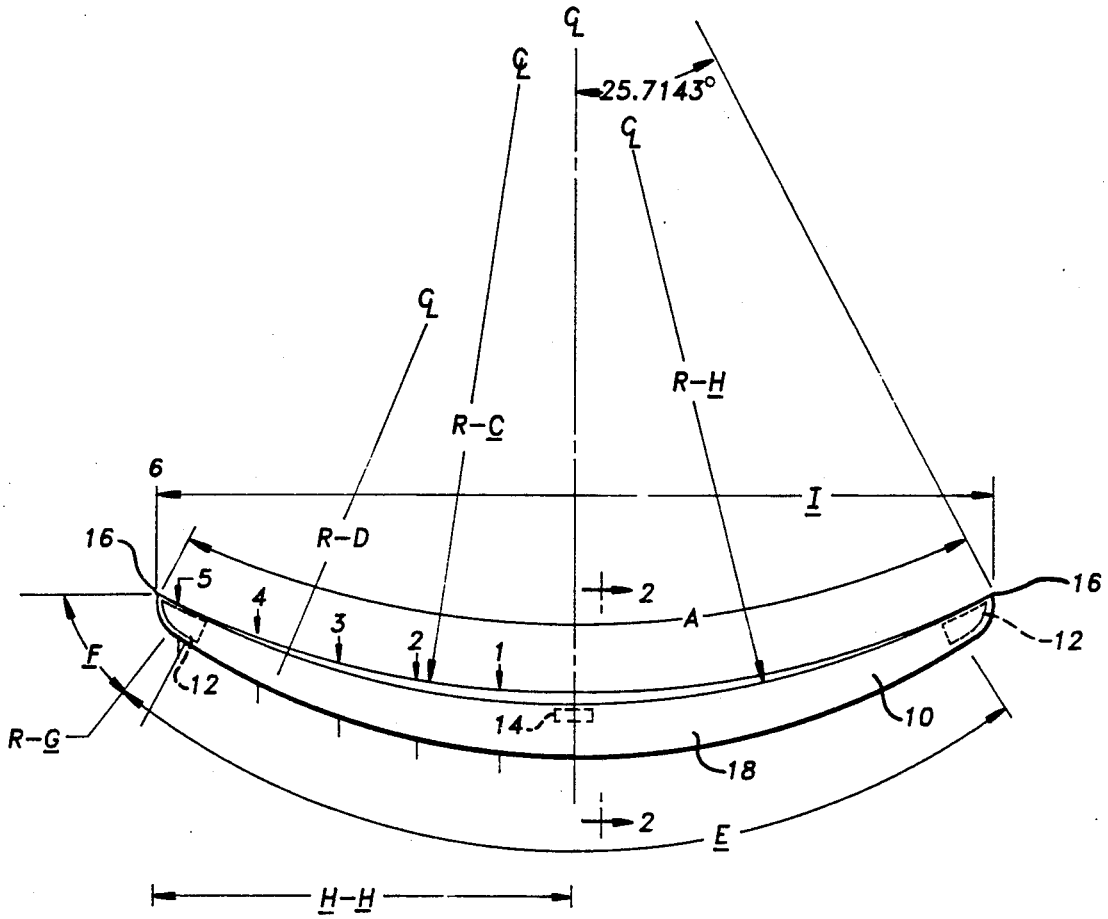
FIG. 1 is a side view of the device showing the geometric centerline, a variety of radii, the specific values of which are given below, and the symmetric placement of weights if desired.
Figure 2:
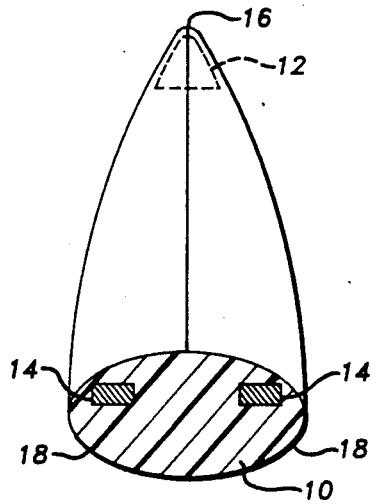
FIG. 2 is a cross-sectional view of the device taken generally along line 2—2 in FIG. 1 at the corresponding centerline, and showing the placement of weights.

The weights 14 in FIGS. 1 and 2 located at sides 18 of device 10 are only for balance and are optional. If the device is made perfectly symmetric along the longitudinal center cutting plane, weights 14 are not needed. Device 10 is a solid body formed of any dense, smooth and rigid material such as, for example only, acrylic, and performs best when rotated or oscillated on a smooth hard and level surface.

Figure 5A:
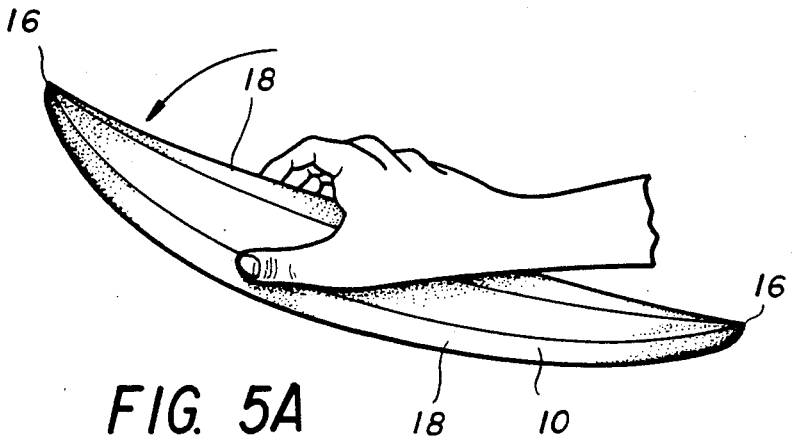
FIGS. 5A–5D are perspective views illustrating operation of the device.
Figure 5B:
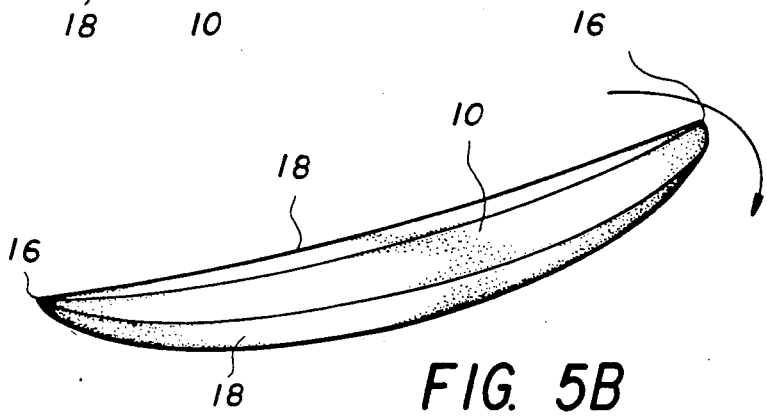
Figure 5C:
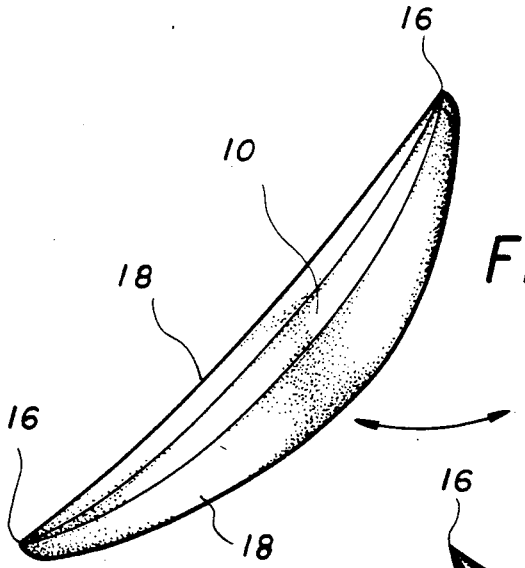
Figure 5D:
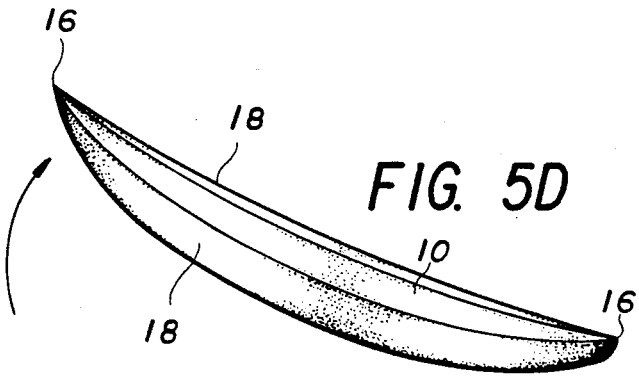

When device 10 is rotated as shown in FIG. 5A, device 10 will eventually stop rotating and begin to rock from end 16 to end 16, then when it reaches a certain rocking frequency start rocking and rotating in the opposite direction which soon becomes a flat level spin as shown in FIG. 5D. Similarly, if device 10 should be initially oscillated end-to-end as shown in FIG. 5B such oscillation will continue until it falls within a certain range of frequencies and then device 10 will start to rock and rotate about its axis without ever pausing between the transition from linear motion as shown in FIG. 5B and rotational motion as shown in FIG. 5D. If device 10 is rocked from side to side as shown in FIG. 5C, it will begin rocking and rotating in a counterclockwise direction until a flat level is attained as shown in FIG. 5A. Unlike the large rotating motion of the end to end rocking, this rotation is small and can be destabilizing to the clockwise rotation if it becomes too great. While the phenomena is not fully understood, it is believed that the forces encountered are significant in view of the laws of inertia.

Device 10 is useful as a child's toy, particularly a rotatable top, which effectively would serve to teach many scientific principles to the child, particularly with regard to the laws of inertia and simple harmonic motion. Further, device 10 may find other uses, such as an amusement ride (rotating teether-totter) or as a flywheel.

Figure 3:
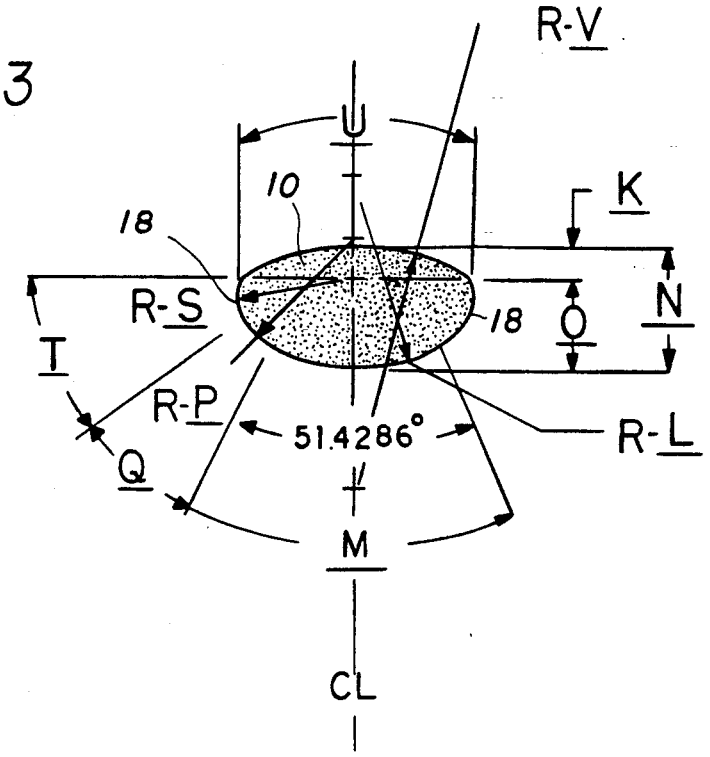
FIG. 3 is another cross-sectional view of the device taken generally along line 3—3 of FIG. 4 at the corresponding centerline, showing a variety of radii, the values of which are given below.
Figure 4:
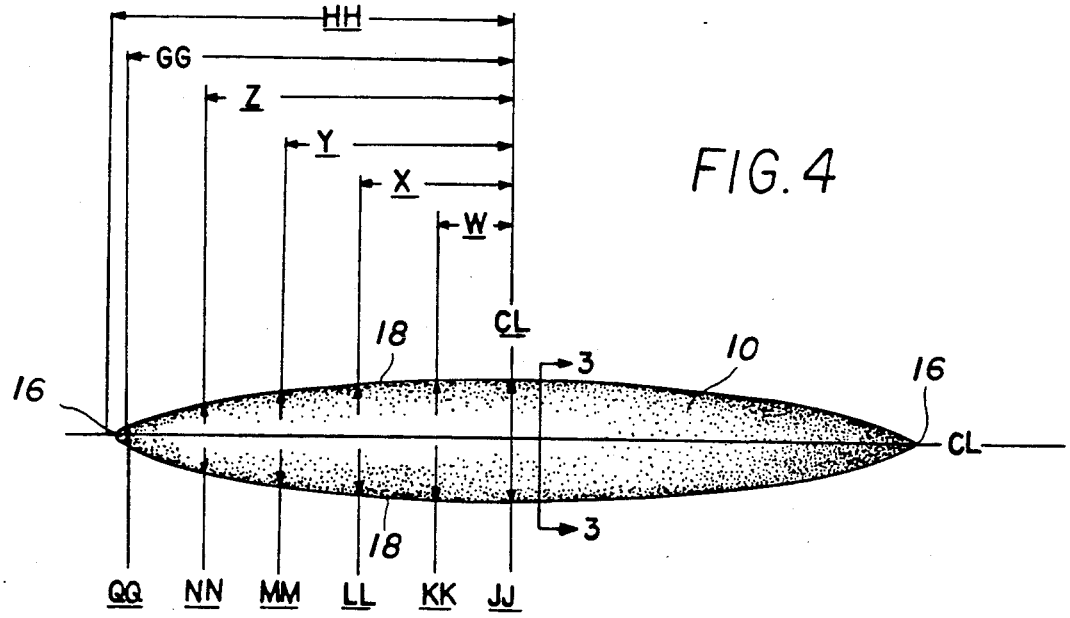
FIG. 4 is a top plan view of the device, identifying areas of body width corresponding to the chart given below.

Provided herein is Table I provided with dimensional ratios which, when considered with FIGS. 1, 3 and 4, will enable one skilled in the art to reproduce the invention. The dimensional data in Table I was attained by creating a large number of models and altering their design until one of the most effective configurations was found. The inside arc length a, shown in FIG. 1 was measured and all other dimensions were assigned a mathematical ratio to this datum. The formula enables the creation of a device of any size or unit of measure by assigning datum "A" a value.

Table I is arranged to have three columns entitled "Shape", "Assembly Mark", and "Dimension". The column labeled "Shape" identifies the portion of device 10 being measured. The second column provides an assembly mark or reference character which connects the first column identification to FIGS. 1, 3 and 4. The first line of column 3 in Table I identifies specifically the length the length of inside are A shown in FIG. 1. The remaining lines provide ratios or fractional multipliers by which the datum representing inside are length A may be multiplied to provide a measurement at a particular location. The multipliers were determined initially by trial and error. As an example of the use of the chart, once the inside arc length A has been measured, inside arc radius C would be determined by multiplying the arc length A by the multiplier 1.1173. Similar calculations are made for each of the shapes identified by the respective assembly marks in Table I.

In FIGS. 1 and 3, an underlined assembly mark representing a radius is preceded by a capital "R", as for example "R-C", "R-D", "R-G", "R-H", "R-L", "R-P", "R-S", and "R-V". Assembly marks E, F, I, K, M, N, O, Q, T, U, V, W, X, Y, Z, GG, and HH represent lengths in FIGS. 1 and 3; assembly marks C, D, G, H, L, P, S, V, W @ 1, X @ 1, X @ 2, Y @ 3, Z @ 4, GG @ 5, and HH @ 6 represent radii, and assembly marks JJ, KK, LL, MM, NN and QQ represent body width. Each of the radii shown in FIGS. 1 and 3 extend from the vertical centerline CL.

TABLE I

| Shape | Assembly Mark | Dimension |
|---|---|---|
| INSIDE ARC LENGTH | A | = DATUM |
| INSIDE ARC RADIUS | C | = A × 1.1173 |
| OUTSIDE ARC RADIUS | D | = A × .8651 |
| OUTSIDE ARC LENGTH | E | = A × .9500 |
| OUTSIDE TIP LENGTH | F | = A × .0714 |
| OUTSIDE TIP RADIUS | G | = A × .0714 |
| CHAMFER WIDTH RADIUS | H | = A × 1.0231 |
| CORD LENGTH | I | = A × 1.0032 |
| CHAMFER HEIGHT | K | = A × .0147 |
| BOTTOM RADIUS | L | = A × .1400 |
| BOTTOM LENGTH | M | = A × .1260 |
| OVERALL HEIGHT | N | = A × .0700 |
| BASE HEIGHT | O | = A × .0553 |
| MID-SIDE RADIUS | P | = A × .0833 |
| MID-SIDE LENGTH | Q | = A × .0411 |
| SIDE RADIUS | S | = A × .0686 |
| SIDE LENGTH | T | = A × .0429 |
| TOP SURFACE LENGTH | U | = A × .1496 |
| TOP SURFACE RADIUS | V | = A × .1428 |
| SEGMENT LENGTH | W | = A × .0975 |
| SEGMENT LENGTH | X | = A × .1950 |
| SEGMENT LENGTH | Y | = A × .2923 |
| SEGMENT LENGTH | Z | = A × .3900 |
| SEGMENT LENGTH | GG | = A × .4874 |
| SEGMENT LENGTH | HH | = A × .5118 |
| SEGMENT RADIUS | W @ 1 | = A × .0952 |
| SEGMENT RADIUS | X @ 2 | = A × .1905 |
| SEGMENT RADIUS | Y @ 3 | = A × .2857 |
| SEGMENT RADIUS | Z @ 4 | = A × .3810 |
| SEGMENT RADIUS | GG @ 5 | = A × .4762 |
| SEGMENT RADIUS | HH @ 6 | = A × .5000 |
| BODY WIDTH | JJ | = A × .1400 |
| BODY WIDTH | KK | = A × .1370 |
| BODY WIDTH | LL | = A × .1250 |
| BODY WIDTH | MM | = A × .1071 |
| BODY WIDTH | NN | = A × .0804 |
| BODY WIDTH | QQ | = A × .0238 |

While it will be apparent that the preferred embodiment of the invention herein disclosed is well calculated to fulfill the objects above-stated, it will be appreciated that the invention is susceptible to modification, variation and change without departing from the proper scope or fair meaning of the subjoined claims.

I claim:

1. A self-reversing symmetrical body having a center of gravity, a geometric center, ends and sides, an arcuate configuration from end to end of said body, a substantially elliptical-shaped top and bottom surface, and a symmetrical vertical cross-section transverse to said top and bottom surface such that the center of gravity is vertically displaced from the geometric center, whereby upon rotation in one direction of the body upon a smooth surface the body will rotate for a period of time before starting to rock end to end, and then, without additional input of energy the body will rotate in a direction opposite said one direction, and said body when initially oscillated selectively from end to end will eventually switch from oscillation to rotation in said one direction, without any additional input of energy.

2. A self-reversing symmetrical body as in claim 1, wherein said body is formed of any dense smooth and rigid material.

3. A self-reversing symmetrical body as in claim 1, wherein counterweights are symmetrically added to the ends of said body whereby a frequency of rocking dependent upon a distance between the center of gravity and the geometric center may be changed.

4. A self-reversing symmetrical body as in claim 1, said body having dimensions of length, width, height and radius determined by selectively multiplying an inside arc length by predetermined ratios.

* * * * *